US006799341B2

(12) United States Patent
Wootten, Jr.

(10) Patent No.: US 6,799,341 B2
(45) Date of Patent: Oct. 5, 2004

(54) FITTED CRIB SHEET

(76) Inventor: Gerald E. Wootten, Jr., 298 County Rd. 1468, Cullman, AL (US) 35066

( * ) Notice: Subject to any disclaimer, the term of this patent is extended or adjusted under 35 U.S.C. 154(b) by 13 days.

(21) Appl. No.: 10/346,178

(22) Filed: Jan. 17, 2003

(65) Prior Publication Data

US 2004/0139547 A1 Jul. 22, 2004

(51) Int. Cl.[7] ..... A47G 9/04
(52) U.S. Cl. ..... 5/497; 5/498; 5/499
(58) Field of Search ..... 5/497, 482, 498, 5/499

(56) References Cited

U.S. PATENT DOCUMENTS 4,461,048 A * 7/1984 Allaire, Jr. ..... 5/497
4,703,530 A * 11/1987 Gusman ..... 5/497
5,177,821 A * 1/1993 Kawtoski ..... 5/497

* cited by examiner

*Primary Examiner*—Teri Pham Luu
*Assistant Examiner*—Fredrick Conley
(74) *Attorney, Agent, or Firm*—Dykema Gossett PLLC

(57) ABSTRACT

A fitted sheet for a crib mattress includes an elongated main body which defines opposite side sections and opposite end sections, respective end panels stitched to the end sections, the end sections and end panels being stitched to respective side sections. An elastic binder is stitched to inner edges of the side sections and the end panels. The fitted sheet, once placed on a crib mattress, will strongly resist unwanted dislodgements from the mattress corners.

8 Claims, 3 Drawing Sheets

FITTED CRIB SHEET

BACKGROUND OF THE INVENTION

1. Field of the Invention

The present invention relates to bedclothes, and more particularly to fitted sheets for mattresses such as crib mattresses used by infants and toddlers.

2. The Prior Art

Fitted bedclothes, e.g., fitted sheets, for mattresses are well known. They extend over the top and sides of the mattress they are intended to fit, and they also extend under the mattress. They usually include elastic binders along their inner peripheries to stretch them around and under the associated mattresses. However, with crib mattresses intended for use by infants and toddlers, it is of utmost importance that the fitted sheets remain in place despite vigorous movements of the infant or toddler thereon which occur during sleep or while playing in the crib. Any dislodging of the fitted sheet from around the corners of the crib mattress could result in a balling of the sheet along the sides or top of the mattress, which could create a hazardous situation, especially for infants.

I have developed a fitted sheet, particularly for crib mattresses, which will fit tightly over and around the crib mattress and will strongly resist unwanted dislodgement during use, i.e., it will resist corner dislodgement from around a mattress by a 14 pound applied force.

SUMMARY OF THE INVENTION

According to my invention, the fitted sheet is formed from a flat pattern which includes an elongated main body that provides opposite first and second side sections and opposite first and second end sections. First and second end panels are respectively attached to the first and second end sections, and the first and second end sections and the first and second end panels are attached to the respective first and second side sections. An elastic band is attached to inner edges of the first and second side sections and the first and second end panels. The resulting fitted sheet, which due to the end panels includes additional material under the mattress, is very reliable in staying in place when mounted on a mattress and will strongly resist corner removal from the mattress.

The invention will be better understood by reference to the attached drawings, taken in conjunction with the following discussion.

DETAILED DESCRIPTION OF THE PREFERRED EMBODIMENT

Figure 1:
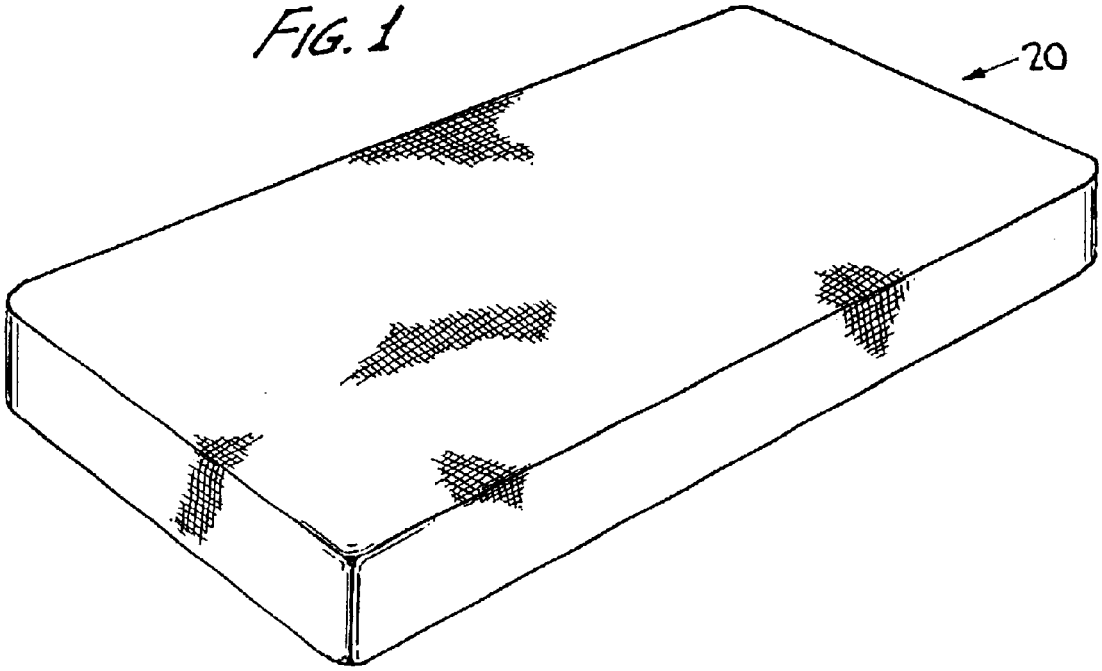
FIG. 1 is a top perspective view of a crib sheet according to a preferred embodiment when mounted on a crib mattress.
Figure 2:
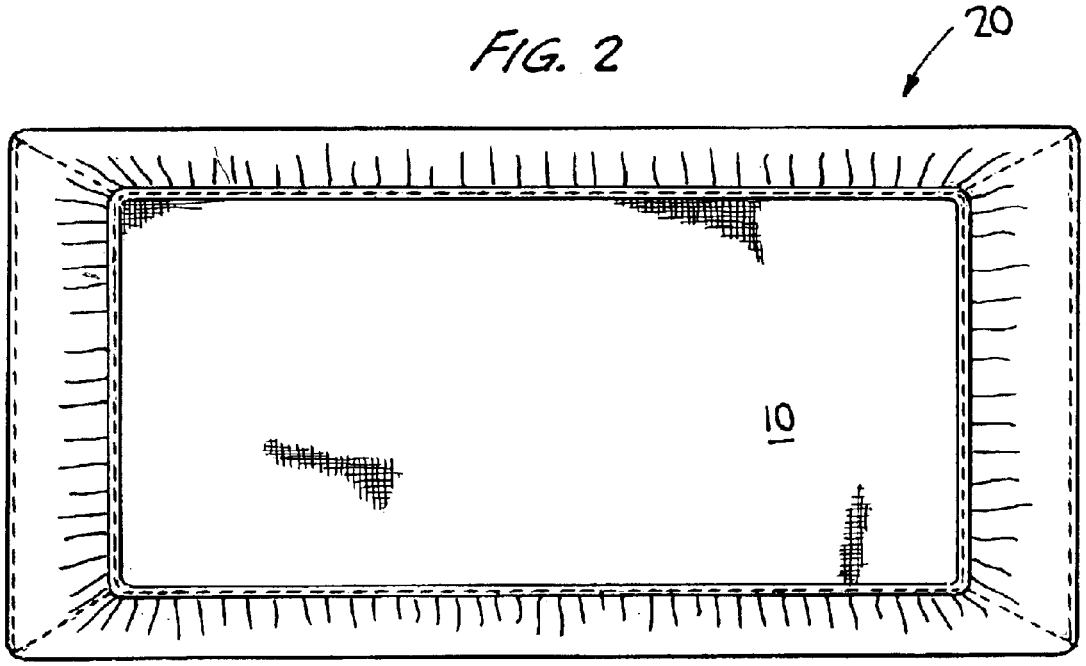
FIG. 2 is a bottom plan view of the crib sheet and crib mattress of FIG. 1.
Figure 3:
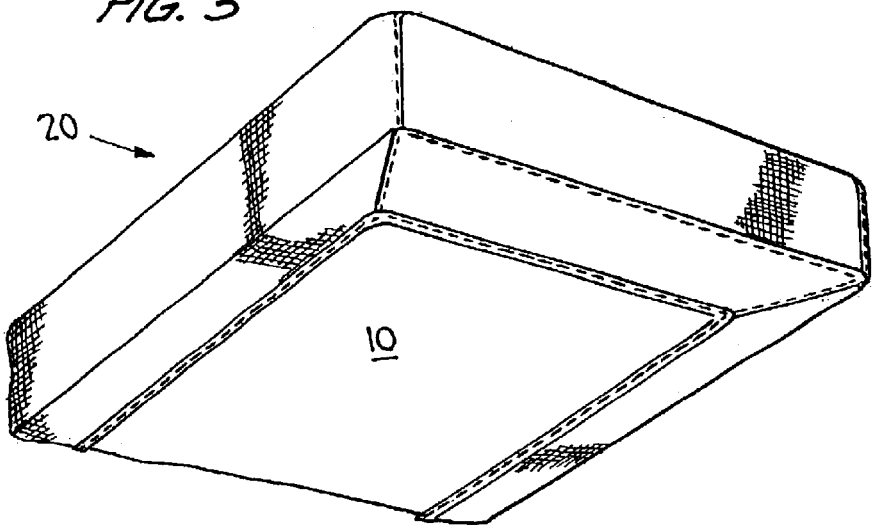
FIG. 3 is a bottom perspective view of the crib sheet and crib mattress of FIG. 1.

A crib sheet 20 according to a preferred embodiment of this invention is shown in FIGS. 1–3 mounted on a mattress 10.

Figure 5:
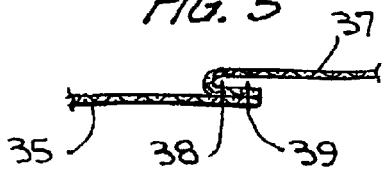
FIG. 5 is a cross section of FIG. 4 as seen along line 5—5.
Figure 4:
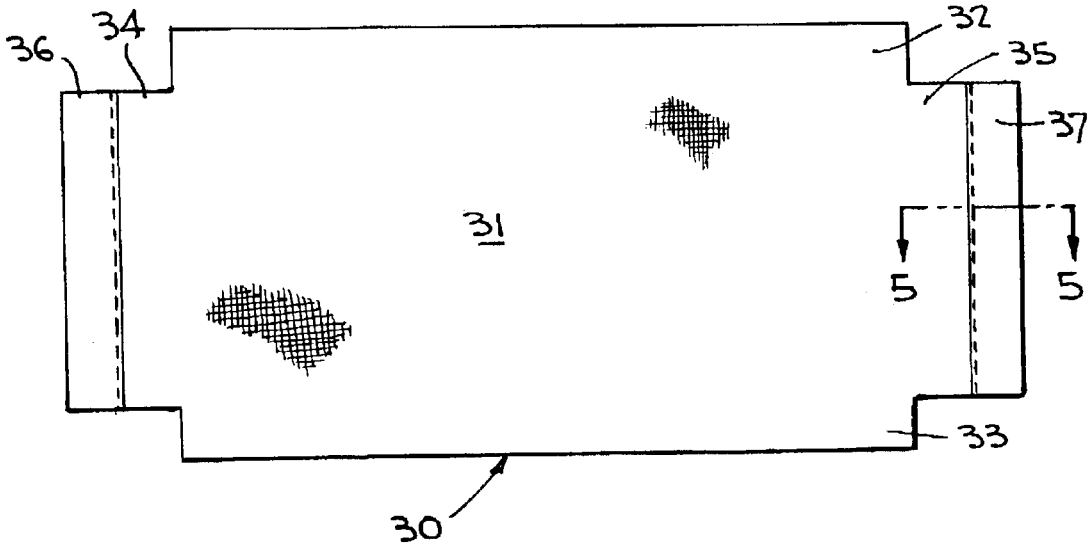
FIG. 4 is a top plan view of the flat pattern used to make the crib sheet shown in FIG. 1.

The crib sheet is formed from a pattern 30 as depicted in FIG. 4. It is seen to include a main body 31, which includes opposite first and second side sections 32, 33, and opposite first and second end sections 34, 35; and respective left and right end panels 36, 37. The end panels 36, 37 are respectively attached to the end sections 34, 35 by double stitching 38, 39 as indicated in FIG. 5. The side sections, end sections and end panels are generally rectangular in shape.

Figure 6:
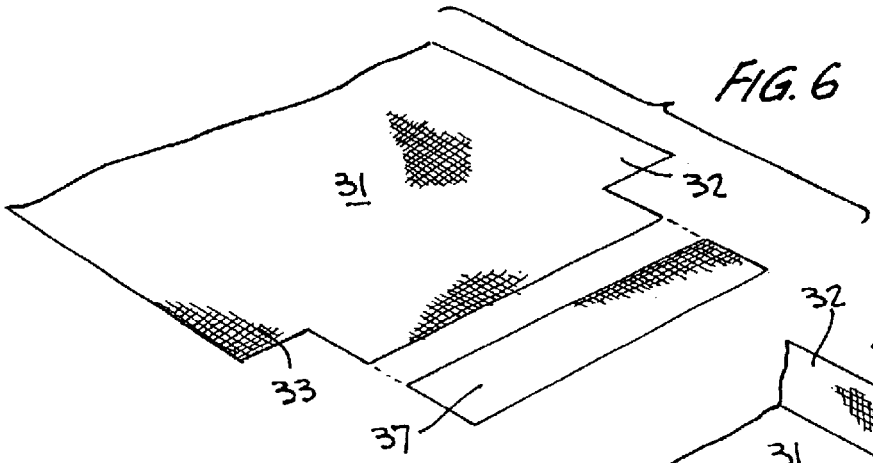
FIG. 6 is a perspective view of the right end portion of the flat pattern of FIG. 4 with the second end panel shown separated from the main body.

FIG. 6 shows the right end portion of the flat pattern showing the second end panel 37 separated from the second end section 35, i.e., prior to attachment thereto.

In the crib sheet 20, respective ends of the second end section 35 are attached to the end portion of the respective ends of the first and second side sections 32, 33 by double stitching. This is, e.g., shown in FIG. 7, which shows the second end panel 37 separated (not yet attached) to the second end section 35.

Figure 8:
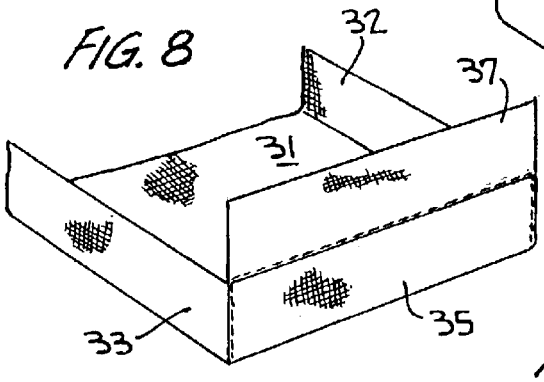
FIG. 8 is a perspective view of the right end portion of the flat pattern as shown in FIG. 7 after the second end panel has been attached to the second end section of the main body.
Figure 9:
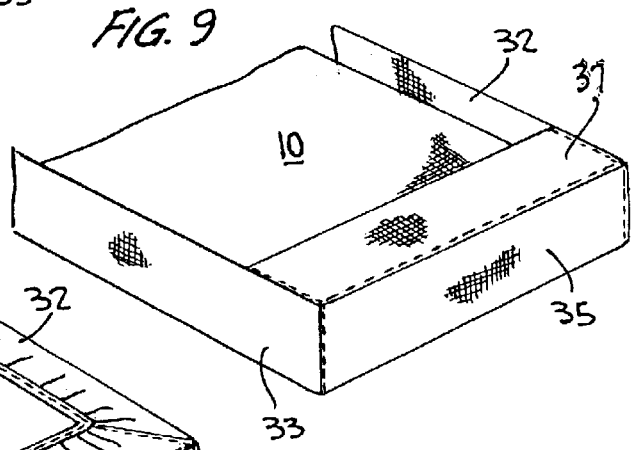
FIG. 9 is a perspective view of the right end portion of the flat pattern shown in FIG. 8 after the second end panel has been attached to the respective side sections of the main body, the right end portion of the crib mattress being shown therein.

FIG. 8 shows the right end portion of the flat pattern after the second end panel 37 has been attached (e.g., by double stitching) to the second end section 35, whereas FIG. 9 shows the second end portion of the flat pattern after the opposite ends of the second end section 35 have been attached (e.g., by double stitching) to the respective first and second side sections 32, 33. The crib mattress 10 is depicted therein.

Figure 10:
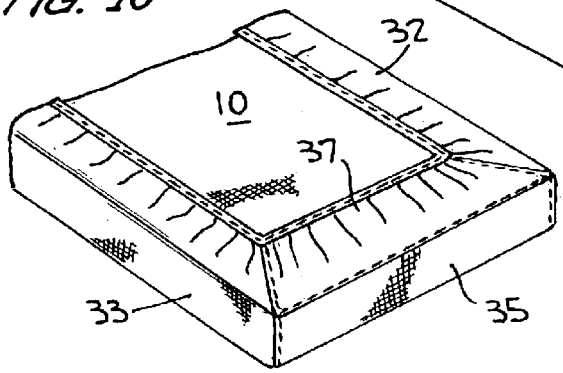
FIG. 10 is a perspective view of the right end portion of the flat pattern as shown in FIG. 9 after an elastic binder has been attached to the inner peripheries of the first and second side sections of the main body and the first and second end panels, the elastic binder causing the crib sheet to fit tightly on the crib mattress.
Figure 3:
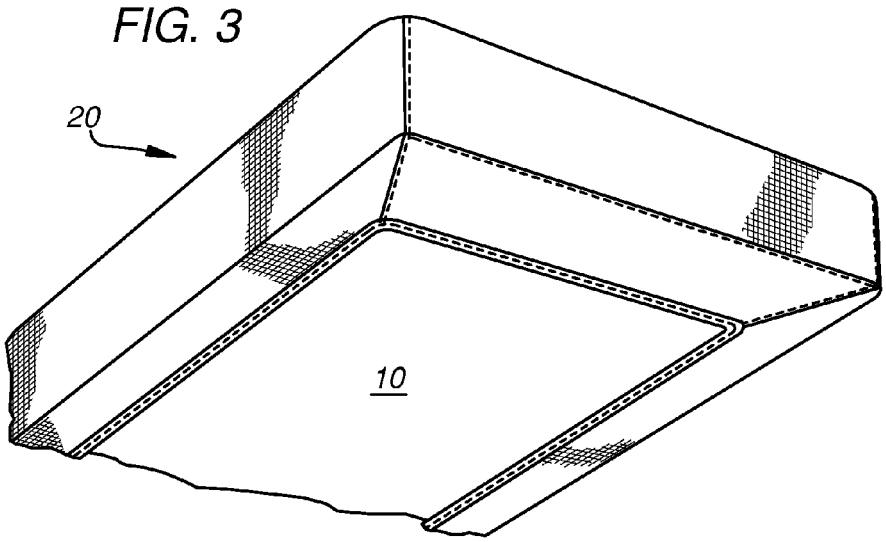
Figure 5:
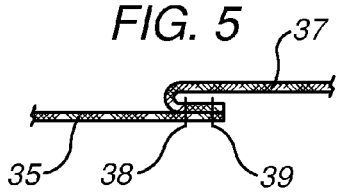
Figure 10:
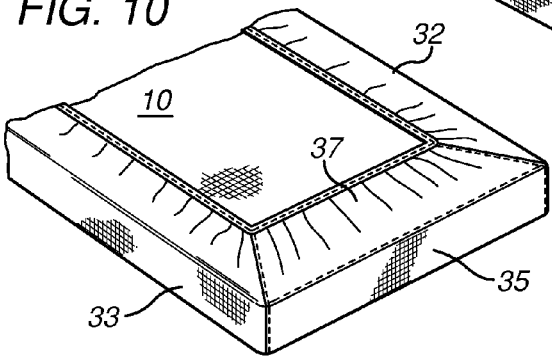

An elastic binder 40 is attached to the inner peripheries of the sections 32, 33 and the end panels 36, 37. FIG. 10 shows the configuration of the side sections 32, 33 and the second end panel 37 drawn taught over the sides and underside of the mattress 10.

The crib sheet can be made of any of the commonly used fabric materials, such as safety fabric, cotton, linen, flannel, velour, satin, sateen, etc.

Although a preferred embodiment of the invention has been shown and described, changes can be made and still fall within the scope of the appended claims. For example, corner straps can be placed between the end panels and the adjacent side sections for even greater stability of the sheet on the mattress. The invention is applicable to bedding items other than sheets, such as anti-allergy covers, fitted blankets, fitted mattress pads, fitted moisture barriers, etc.

I claim:

1. A fitted sheet for a mattress which comprises an elongated main body section which defines opposite first and second side sections and opposite first and second end sections, adjacent edges of said side and end sections being attached together, a first end panel which is stitched to said first end section and stitched to said respective first and second side sections, a second end panel which is stitched to said second end section and stitched to said respective first and second side sections, and an elastic band which is connected to inner peripheries of said first and second side sections and said first and second end panels so that said side sections, said end sections and said end panels will tightly fit against the sides of a mattress and extend thereunder to tightly fit the fitted sheet on the mattress.

2. The sheet of claim 1, wherein said first and second sides and first and second end sections are connected by stitching.

3. The sheet of claim 1, wherein said first and second side sections are generally rectangular in shape.

4. The sheet of claim 3, wherein said first and second end sections are generally rectangular in shape.

5. The sheet of claim 4, wherein said first and second end panels are generally rectangular in shape.

6. The sheet of claim 1, wherein said main body and first and second end panels are made of cotton.

7. The sheet of claim 1, wherein said main body and first and second end panels are made of linen.

8. The combination of a crib mattress and a fitted sheet, said fitted sheet comprising an elongated main body section which defines opposite first and second side sections and opposite first and second end sections, adjacent edges of said side and end sections being attached together, a first end panel which is stitched to said first end section and stitched to said respective first and second side sections, a second end panel which is stitched to said second end section and stitched to said respective first and second side sections, and an elastic band which is connected to inner peripheries of said first and second side sections and said first and second end panels so that said side sections, said end sections and said end panels will tightly fit against the sides of the mattress and extend thereunder to tightly fit the fitted sheet on the mattress.

* * * * *

US006799341C1

(12) EX PARTE REEXAMINATION CERTIFICATE (9755th)

United States Patent
Wootten, Jr.

(10) Number: US 6,799,341 C1
(45) Certificate Issued: Jul. 17, 2013

(54) FITTED CRIB SHEET

(75) Inventor: Gerald E. Wootten, Jr., Cullman, AL (US)

(73) Assignee: Homtex, Inc., Vinemont, AL (US)

Reexamination Request:
No. 90/011,779, Jun. 30, 2011

Reexamination Certificate for:

| | |
|---|---|
| Patent No.: | **6,799,341** |
| Issued: | **Oct. 5, 2004** |
| Appl. No.: | **10/346,178** |
| Filed: | **Jan. 17, 2003** |

(51) Int. Cl.
*A47G 9/02* (2006.01)

(52) U.S. Cl.
USPC ..... 5/497; 5/498; 5/499

(58) Field of Classification Search
None
See application file for complete search history.

(56) References Cited

To view the complete listing of prior art documents cited during the proceeding for Reexamination Control Number 90/011,779, please refer to the USPTO's public Patent Application Information Retrieval (PAIR) system under the Display References tab.

*Primary Examiner* — Peter C. English

(57) ABSTRACT

A fitted sheet for a crib mattress includes an elongated main body which defines opposite side sections and opposite end sections, respective end panels stitched to the end sections, the end sections and end panels being stitched to respective side sections. An elastic binder is stitched to inner edges of the side sections and the end panels. The fitted sheet, once placed on a crib mattress, will strongly resist unwanted dislodgements from the mattress corners.

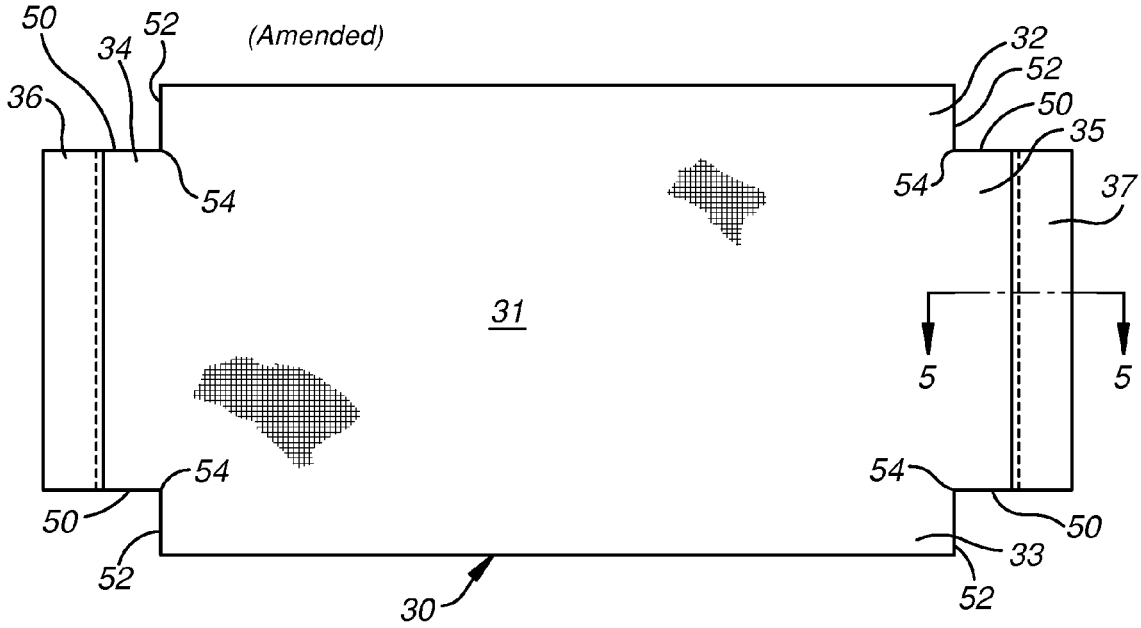

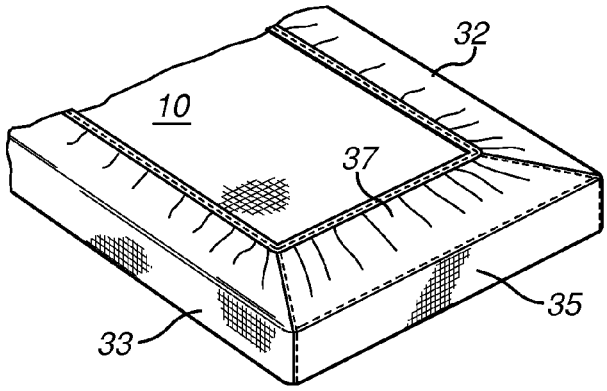

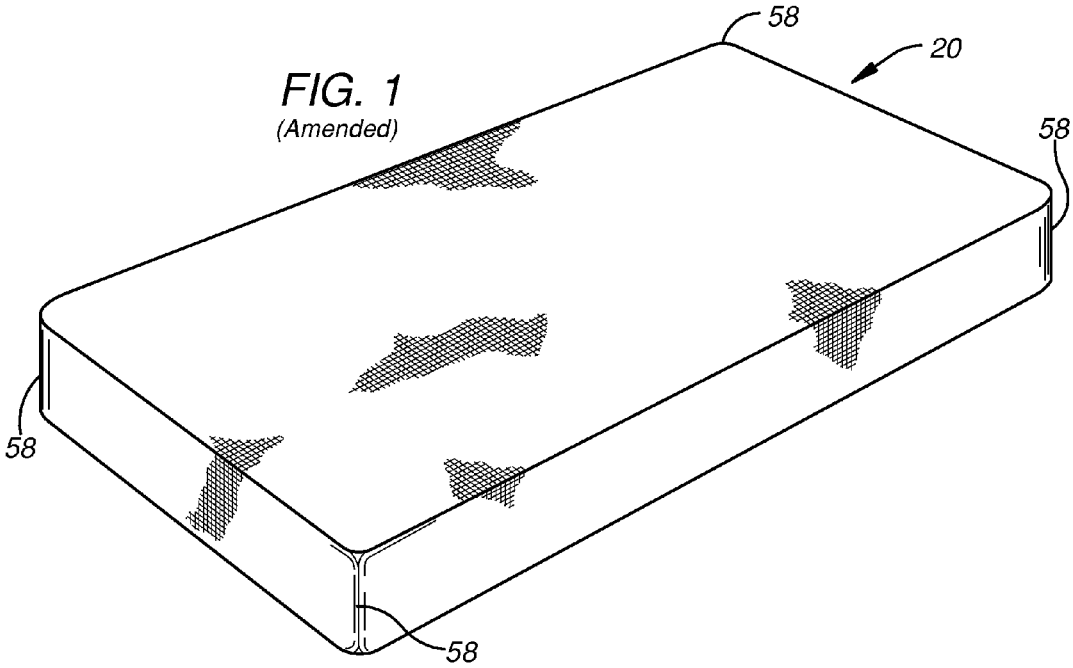
FIG. 1
(Amended)
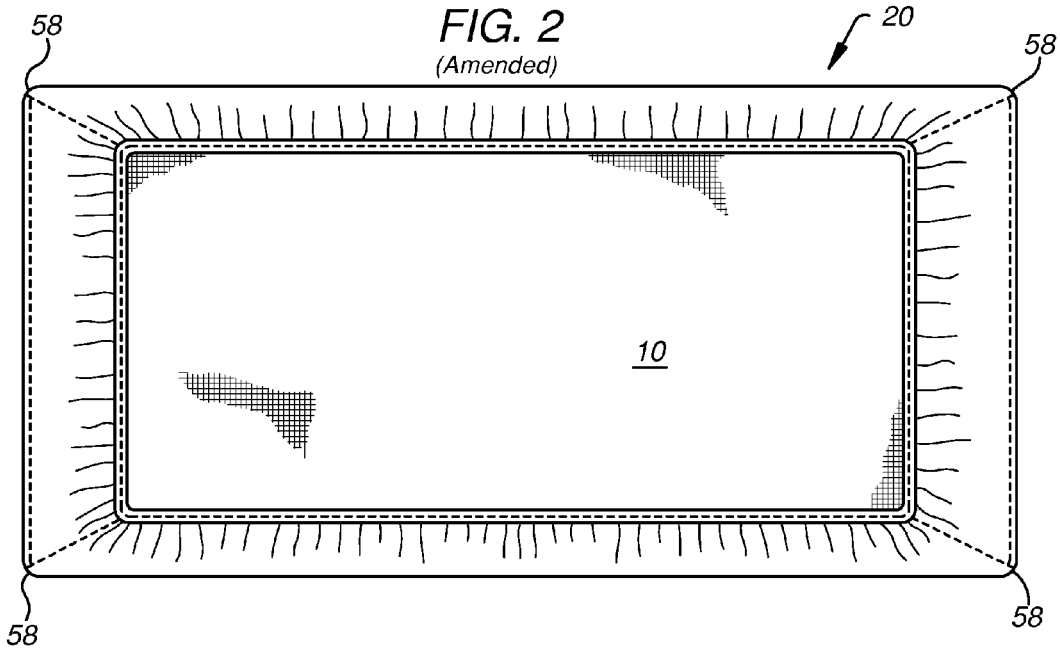
FIG. 2
(Amended)

FIG. 4
(Amended)
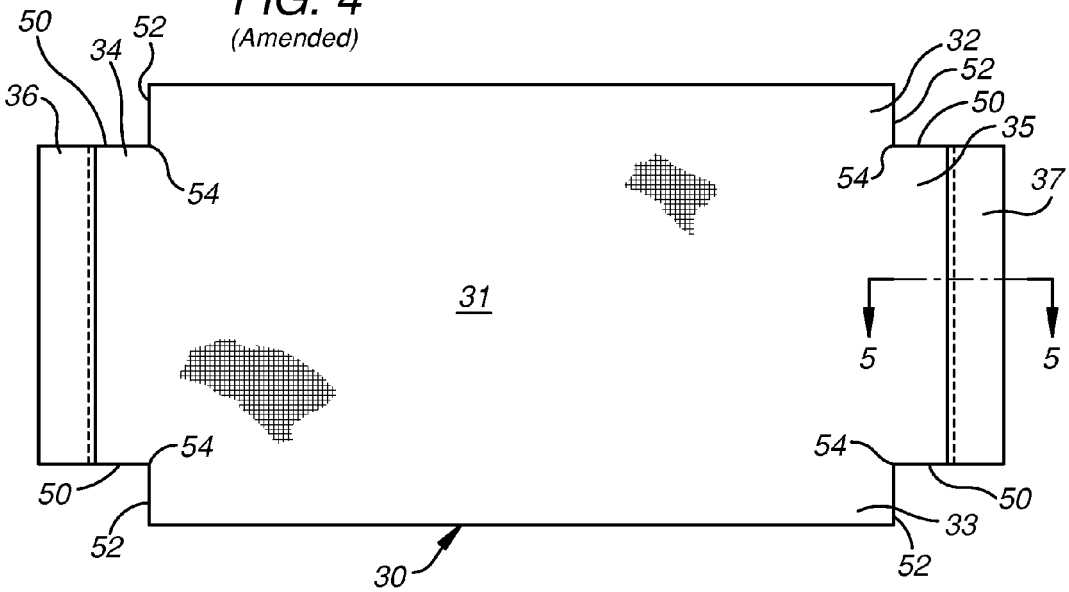

Figure 7:
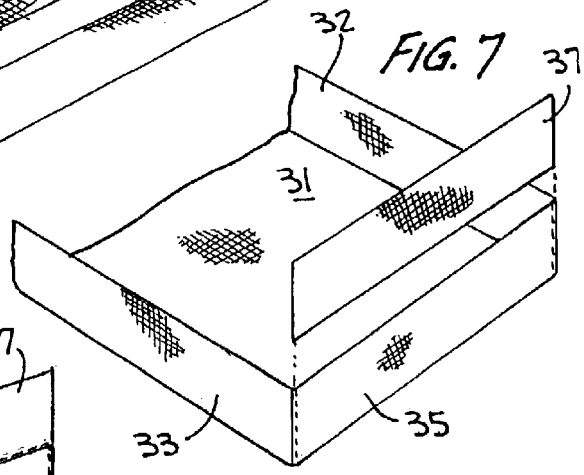
FIG. 7 is a perspective view of the right end portion of the flat pattern as shown in FIG. 6 after the second end section and the first and second side sections of the main body have been attached together, the second end panel being shown separated from the second end section.

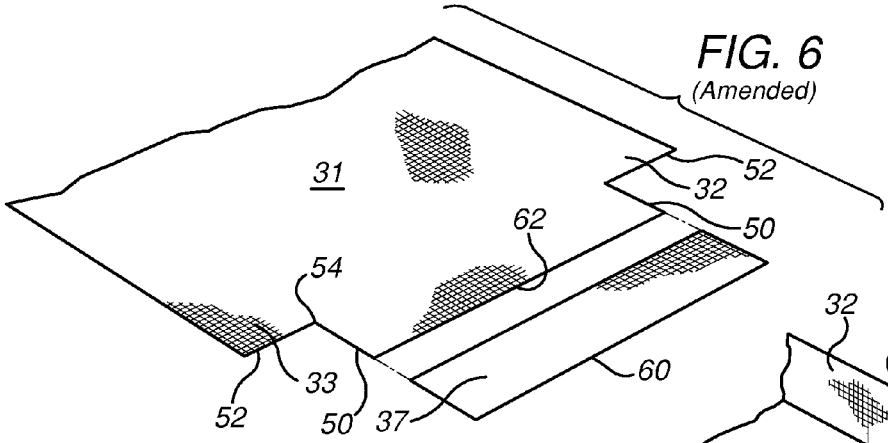
FIG. 6
(Amended)
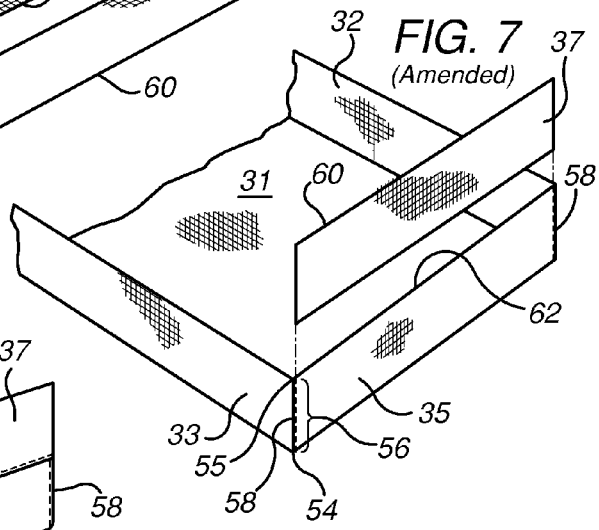
FIG. 7
(Amended)
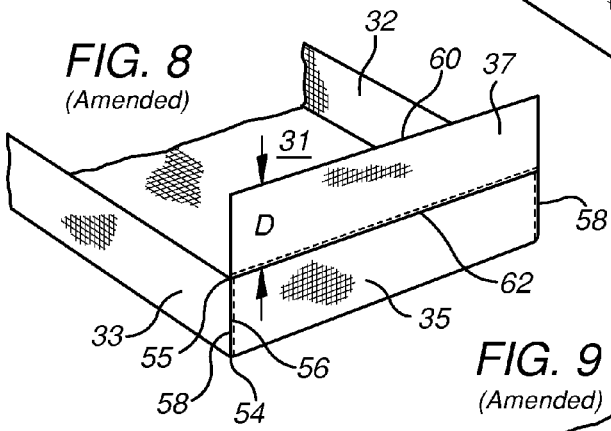
FIG. 8
(Amended)
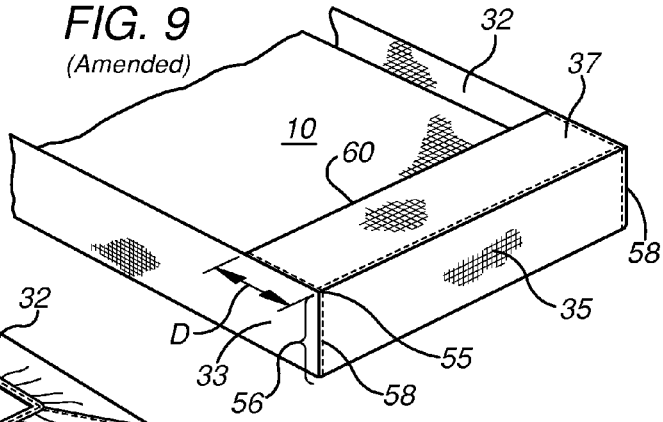
FIG. 9
(Amended)

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

ONLY THOSE PARAGRAPHS AFFECTED BY AMENDMENT ARE PRINTED HEREIN.

Column 2 after line 56:

*Referring to FIGS. 4, and 6-9, end sections 34, 35 include ends 50 that are positioned adjacent ends 52 of side sections 32, 33. Ends 50, 52 meet at a location 54. Adjacent ends 50, 52 are attached together by a line of stitching 56 to form a respective comer 58 of the sheet 20. Four comers 58 are shown as being formed on the sheet 20 (shown best in FIG. 2). The line of stitching 56 is shown as extending from the location 54 positioned at an outer periphery of the end section 34, 35 to a location 55 that is on an inner periphery 62 of the end section 34, 35. Thus, location 55 is spaced below location 54 when the sheet is installed on a mattress. The end panel 37 has an inner periphery 60 that is shown as being spaced a distance D from the line of stitching 56 at the comer 58. The end panels 36, 37 are shown as being stitched to their adjacent end sections 34, 35 along an inner periphery 62 of the end sections 34, 35.*

*The end panels 36, 37, side sections 32, 33, and end sections 34, 35 each have a width and a length. The length of each section and panel is greater than a corresponding width. The length of the end sections 34, 35 are shown as being substantially the same as the length of the end panels 36, 37. The width of the end sections 34, 35 are shown as being substantially the same as the width of the end panels 36, 37. The width of the side sections 32, 33 are shown as being substantially the same as the width of the end sections 34, 35.*

*Referring to FIGS. 2, 3, 9, and 10, the end panels 36, 37 are shown as being positioned entirely under the mattress so that the end panels 36, 37 would be out of view by a user when the sheet is installed on a mattress. The side sections 32, 33 are shown as wrapping around the bottom of the mattress when the sheet is installed on a mattress.*

*The side sections 32, 33 and end sections 34, 35 are shown as being integral with the main body 31 of the sheet 20.*

THE DRAWING FIGURES HAVE BEEN CHANGED AS FOLLOWS:

"58" added to FIGS. 1 & 2; "50", "52" & "54" added to FIGS. 4 & 6; "60" & "62" added to FIGS. 6, 7 & 8; "54" added to FIGS. 7 & 8; "55", "56" & "58" added to FIGS. 7, 8 & 9; "D" added to FIGS. 8 & 9.

AS A RESULT OF REEXAMINATION, IT HAS BEEN DETERMINED THAT:

Claims 1-8 are cancelled.

New claims 9 and 10 are added and determined to be patentable.

*9. A fitted sheet for a mattress comprising:*

*a sheet pattern having a substantially rectangular elongated main body with two opposite ends and two opposite sides, two substantially rectangular end sections attached at the opposite ends of the main body and two substantially rectangular side sections attached at the opposite sides of the main body, with each side and end section having a side edge for attaching with an adjacent end or side section side edge via an attachment mechanism to form the corners of the fitted sheet, with the sheet pattern with attached corners having an inner periphery defined by the two end sections and two side sections, the end and side sections wrap around the sides and part of the bottom of a mattress in use;*

*a first fabric end panel stitched to the inner periphery of one of the end sections and to the two side sections such that when said fitted sheet is positioned on a mattress, the first fabric end panel is under the mattress;*

*a second fabric end panel stitched to the inner periphery of the other end section and to the two side sections such that when said fitted sheet is positioned on a mattress, the second fabric end panel is under the mattress; and*

*an elastic band connected to inner peripheries of the first and second end panels and the first and second side sections for pulling the sheet taut when installed on a mattress so that said side sections, said end sections, and said end panels will fit tightly against the sides of the mattress and extend thereunder to tightly fit the fitted sheet on the mattress.*

*10. The fitted sheet of claim 9, wherein the side and end sections are integral with the main body and the attachment mechanism utilized at the corners is stitching.*

* * * * *